US009126250B2

(12) United States Patent
Chazal et al.

(10) Patent No.: US 9,126,250 B2
(45) Date of Patent: Sep. 8, 2015

(54) LEVELING MACHINE WITH MULTIPLE ROLLERS

(75) Inventors: Jean-Pierre Chazal, Trelins (FR); Bernard Dumas, Montbrison (FR); Vincent Philippaux, Montbrison (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 639 days.

(21) Appl. No.: 13/395,171

(22) PCT Filed: Sep. 30, 2009

(86) PCT No.: PCT/EP2009/062659

§ 371 (c)(1),
(2), (4) Date: Mar. 29, 2012

(87) PCT Pub. No.: WO2011/029485

PCT Pub. Date: Mar. 17, 2011

(65) Prior Publication Data

US 2012/0174644 A1 Jul. 12, 2012

(30) Foreign Application Priority Data

Sep. 9, 2009 (EP) ..... 09290685

(51) Int. Cl.
*B21D 1/02* (2006.01)
*B21D 37/12* (2006.01)

(52) U.S. Cl.
CPC . *B21D 1/02* (2013.01); *B21D 37/12* (2013.01)

(58) Field of Classification Search
CPC ..... B21D 1/00; B21D 1/02; B21D 1/05
USPC ..... 72/160, 163–165
See application file for complete search history.

(56) References Cited

U.S. PATENT DOCUMENTS

| | | | | |
|---|---|---|---|---|
| 3,777,532 | A | 12/1973 | Noe | |
| 4,881,392 | A | 11/1989 | Thompson et al. | |
| 5,189,896 | A | 3/1993 | Melzer et al. | |
| 5,461,895 | A | 10/1995 | Lemper et al. | |
| 5,479,806 | A | 1/1996 | Benz | |
| 6,029,485 | A * | 2/2000 | Bohmer | 72/7.4 |
| 7,475,581 | B2 * | 1/2009 | Farnik | 72/160 |
| 7,637,133 | B2 * | 12/2009 | Buta | 72/164 |
| 2008/0098786 | A1 * | 5/2008 | Yoshioka | 72/250 |

FOREIGN PATENT DOCUMENTS

| | | | |
|---|---|---|---|
| CN | 2428236 | Y | 5/2001 |
| EP | 05 08 475 | A2 | 10/1992 |

(Continued)

*Primary Examiner* — Debra Sullivan

(74) *Attorney, Agent, or Firm* — Laurence A. Greenberg; Werner H. Sterner; Ralph E. Locher

(57) ABSTRACT

A machine for leveling a strip of material contains a lower stationary back plate from which extends vertical beams located on either side of a longitudinal axis. A lower stationary leveling chassis and an upper leveling chassis are provided. Each chassis contains spaced apart rollers. An upper stationary back plate is rigidly secured to the upper end of each beam, and a moving coupling device couples the upper leveling chassis to the upper back plate. A device allows a vertical translational movement of the upper leveling chassis in relation to the upper stationary back plate between a rest position where the rollers of the upper leveling chassis are moved away from rollers of the lower leveling chassis and a leveling position where rollers of the upper leveling chassis are moved towards rollers of the lower leveling chassis and the strip is forced to travel along an undulating path.

15 Claims, 3 Drawing Sheets

(56) References Cited

FOREIGN PATENT DOCUMENTS

| | | | |
|---|---|---|---|
| EP | 05 70 770 | B1 | 7/1997 |
| FR | 2912073 | A1 | 8/2008 |
| JP | 59-45030 | A | 3/1984 |
| JP | H0475609 | U | 7/1992 |
| JP | 2637577 | B2 | 8/1997 |
| JP | 2000-326012 | A | 11/2000 |
| JP | 4075609 | B2 | 4/2008 |
| RU | 2118920 | C1 | 9/1998 |
| WO | 2008099126 | A2 | 8/2008 |

* cited by examiner

LEVELING MACHINE WITH MULTIPLE ROLLERS

BACKGROUND OF THE INVENTION

Field of the Invention

The invention relates to a machine for leveling thick metal plates or strips that, henceforth, shall be referred to generically as "strips".

Leveling devices, known as levelers, are used to remove flatness defects in strips following hot or cold rolling. Indeed, for example after the hot rolling, cooling and conditioning phases, the rolled products may have non-developable flatness defects, such as defects known as edge wave or center buckle, or developable flatness defects, such as bowing defects. These geometric defects visibly affect rolled products.

Levelers with multiple rollers arranged such that they overlap, establishing an undulating route for the strip, which is then subjected to bending effects in alternating directions, are used to level such rolled metal strips.

A metal plate or strip leveling installation comprises, in general, a lower leveling cassette and an upper leveling cassette, each fitted with a plurality of leveling rollers that are in direct contact with the strip. These leveling rollers are usually supported by support rollers.

These two leveling cassettes are included in the structure of the leveler which comprises vertical beams, the bottoms of which are rigidly connected by a generally fixed back plate and the tops of which are rigidly connected by horizontal upper beams.

The lower cassette is supported by the lower back plate and the upper cassette is supported by a pressure frame to which it is bolted.

Most commonly, the lower cassette is fixed and the upper cassette can move vertically in order to adjust the gap between the leveling rollers and thereby determine the undulating route of the strip. This gap and the transfer of the cassette separation stress, attributable to the resistance of the strip, are effected by hydraulic closing cylinders bearing on one side against the upper beams and on the other against the pressure frame.

A motorized drive system makes it possible to actuate the rollers in rotation and, by friction, to move the strip forward at a given speed. This involves at least one motor driving at least one reduction gear that actuates at least one gearbox at the required speed that distributes the rotation torques to the different lower and upper leveling rollers by means of spindles connected at one end to the outputs of the gearbox and at the other end to the end trunnions of the rollers.

FIG. 1 is a schematic view of a leveling machine in the prior art in which the upper cassette 5*a* is supported by a pressure frame 4 that is movable vertically using hydraulic cylinders bearing against the upper horizontal cross members 3*a*, 3*b* rigidly connected to the vertical beams. The machine comprises a fixed lower back plate 1 supporting a lower leveling cassette 5*b* rigidly connected to two pairs of vertical beams 2*a*, 2*b*. The top of each beam 2*a*, 2*b* is connected to a horizontal cross member 3*a*, 3*b*. A pressure frame 4 guided in vertical translation between the beams 2 is forced on to the upper cassette 5*a* by four closing cylinders 6. Each cassette 5*a*, 5*b* has several leveling rollers 51*a*, 51*b* supported by bearings 52*a*, 52*b* and held by support rollers 53*a*, 53*b*, themselves supported by bearings 54*a*, 54*b*. The leveling machine also includes return cylinders 8 enabling the pressure frame 4 and therefore the upper cassette 5*a* to be moved upwards.

In order to offset the bending of the cassettes, the lower back plate and the upper pressure frame caused by the separation stress attributable to the passage of the strip, several systems have been invented, such as using bend correction cylinders between at least the upper cassette and the pressure frame thereof. Thus, the leveling machine shown in FIG. 1 is fitted with correction cylinders 7 placed between the pressure frame 4 and the upper leveling cassette 5*a*. Coupling devices 9 attach the upper leveling cassette 5*a* to the pressure frame, while enabling movement of the upper leveling cassette 5*a* under the action of the correction cylinders 7.

Other solutions for correcting the bending of cassettes, the lower back plate and the upper pressure frame under the separation stress caused by passage of the strip have been invented. Accordingly, document EP 0 570 770 discloses the use of cylinders arranged between the upper leveling rollers and the upper pressure frame of a leveling machine. These cylinders enable the bending of the leveling rollers occurring during passage of the strip of material between the rollers to be offset. These offsetting rollers act in conjunction with cylinders enabling an upper frame with a rigidly connected upper leveling cassette to be moved. The leveling machine is also fitted with a plurality of sensors measuring the deformation of the rollers and providing information to a processor that controls the offsetting cylinders and the cylinders enabling the frame to be moved.

Document JP A 2000 326012 also discloses a leveling machine comprising a plurality of offsetting cylinders installed between an upper frame and the upper rollers of a leveling machine. Other cylinders bearing against horizontal cross members change the position of the upper leveling rollers by acting on the upper back plate of the leveling machine.

Document U.S. Pat. No. 5,461,895 discloses a leveling machine that, to offset the longitudinal bending of the leveling rollers, comprises a combination of pressure cylinders acting on the middle of the upper cassette and traction cylinders acting on the extremities thereof.

The use of an increasing number of closing and correcting cylinders complicates leveling machines and increases the height of said machines as several levels of these cylinders are stacked. Accordingly, known leveling machines comprise a stack of superimposed layers formed by an upper cassette, bend correction cylinders, the pressure frame, main closing cylinders and upper horizontal cross members. A leveling machine for very wide, thick strips can weigh more than 600 tons and be more than ten meters high. A pressure frame on its own may weigh more than 70 tons. It is therefore important to minimize the mass and size of leveling machines.

The invention is intended to address the problems identified above and, in particular, to limit the stacking of structural members and cylinders in order to limit the height of the machine and, in particular, the length of the vertical beams. It is also intended to provide a leveling machine of lesser volume and mass than known leveling machines, while fulfilling the same functions and, in particular, enabling the bending of leveling cassettes caused by the passage of the material being leveled to be offset.

BRIEF SUMMARY OF THE INVENTION

In consideration of these objectives, the first object of the invention is a machine for leveling a strip of material comprising:

a lower fixed back plate from which extend a plurality of vertical beams, the beams being located on either side of a longitudinal axis of movement of the strip of material, an upper leveling cassette and a lower fixed leveling cassette, during operation of the leveling machine, the lower fixed leveling cassette bearing against the fixed back plate, each cassette having a plurality of rollers spaced out and mounted rotatingly in bearings on axes perpendicular to the longitudinal axis of movement of the material, characterized in that the leveling machine also includes:

an upper fixed back plate rigidly connected to the vertical beams and rigidly attached to the upper extremity of each beam, movable means for coupling the upper leveling cassette to the upper back plate enabling movement of the upper leveling cassette, means for moving the upper leveling cassette in vertical translation in relation to the upper fixed back plate between a resting position in which the rollers of the upper leveling cassette are not close to the rollers of the lower leveling cassette and a leveling position in which the rollers of the upper leveling cassette are close to the rollers of the lower leveling cassette in order to cause the strip to follow an undulating route.

According to other advantageous characteristics:

the mobile coupling means comprise:

a first set of cylinders placed on one side of an imaginary vertical plane passing through the longitudinal axis of movement of the strip of material, each cylinder of the first set being fixed firstly to a flange of the fixed upper back plate and secondly to a retaining hook of the upper leveling cassette, a second set of cylinders placed on the other side of the imaginary vertical plane, each cylinder in the second set being fixed firstly to a part movable in relation to the fixed upper back plate and secondly to a retaining hook (56*b*) of the upper leveling cassette, each movable part is fixed to a flange of the fixed upper back plate and at least one of the movable parts is driven in rotation by drive means, the rotating drive means include at least one cylinder, each cylinder being linked firstly to at least one movable part and secondly to a flange of the upper back plate of the leveling machine, when a drive cylinder is actuated in rotation at least one set comprising a movable part and one cylinder from the second set of cylinders is moved in rotation from a vertical position to a retracted position, the retracted position enabling the upper leveling cassette to be removed from the leveling machine, the lower leveling cassette comprises a plurality of uprights extending upwards from the base of the leveling cassette, each vertical beam has an inner vertical contact surface intended to cooperate with another contact surface to guide at least one leveling cassette of the leveling machine in translation, the lower leveling cassette has at least one outer vertical contact surface intended to cooperate with an inner vertical contact surface of a vertical beam such as to guide the lower leveling cassette in translation, at least one inner vertical contact surface of the lower leveling cassette belongs to an upright of the lower leveling cassette extending upwards from the base of the leveling cassette, the lower leveling cassette has an inner contact surface intended to guide the upper leveling cassette in translation, the upper leveling cassette has at least one outer contact surface to guide it in translation that is intended to cooperate with another contact surface of an element of the leveling machine, each outer contact surface of the upper leveling cassette is convex, each outer contact surface of the upper leveling cassette cooperates with an inner vertical contact surface of a beam, each outer contact surface of the upper leveling cassette cooperates with an inner vertical contact surface of the lower leveling cassette, means for moving the upper leveling cassette in vertical translation include a plurality of closing cylinders (10) rigidly connected to the fixed upper back plate and the upper leveling cassette.

The invention also relates to a flexible leveling cassette the thickness of which varies between a maximum value and a minimum value, and that is intended to cooperate with a leveling machine as defined above.

Advantageously, the leveling cassette comprises a plurality of maximum-thickness zones intended to cooperate with the closing cylinders of the leveling machine, the maximum-thickness zones being separated from one another by a minimum-thickness zone.

Furthermore, the maximum thickness value may be between 1.5 and 4 times the minimum thickness value and may preferably be between 2 and 2.5 times this value.

The total height of the leveling machine according to the invention is therefore less than known machines and, unlike leveling machines in the prior art, it does not have conventional pressure frames or horizontal cross members, which saves tens of tons from the structure and lightens the leveling machine according to the invention.

Furthermore, in relation to leveling machines in the prior art, the invention also enables the retraction cylinders to be removed from the pressure frame and the upper cassette, which represents a significant saving as these cylinders, of which there are normally four, have to be powerful enough to lift a mass of up to around 100 tons. Furthermore, they usually have significant travel in order to enable the closing cylinders to be disassembled. These cylinders are therefore very heavy and require the implementation of high-pressure hydraulic circuits and a significant quantity of oil. Removal of all of these devices has the additional effect of reducing the mass of the leveling machine by several tens of tons.

Other characteristics and advantages of this invention are set out in a detailed non-limiting embodiment provided with reference to the figures, in which:

DESCRIPTION OF THE INVENTION

It should be noted that the figures only show the elements required to understand the invention, it being understood that the leveling machine includes all of the elements (not shown) required to drive the leveling rollers in rotation.

Figure 1:
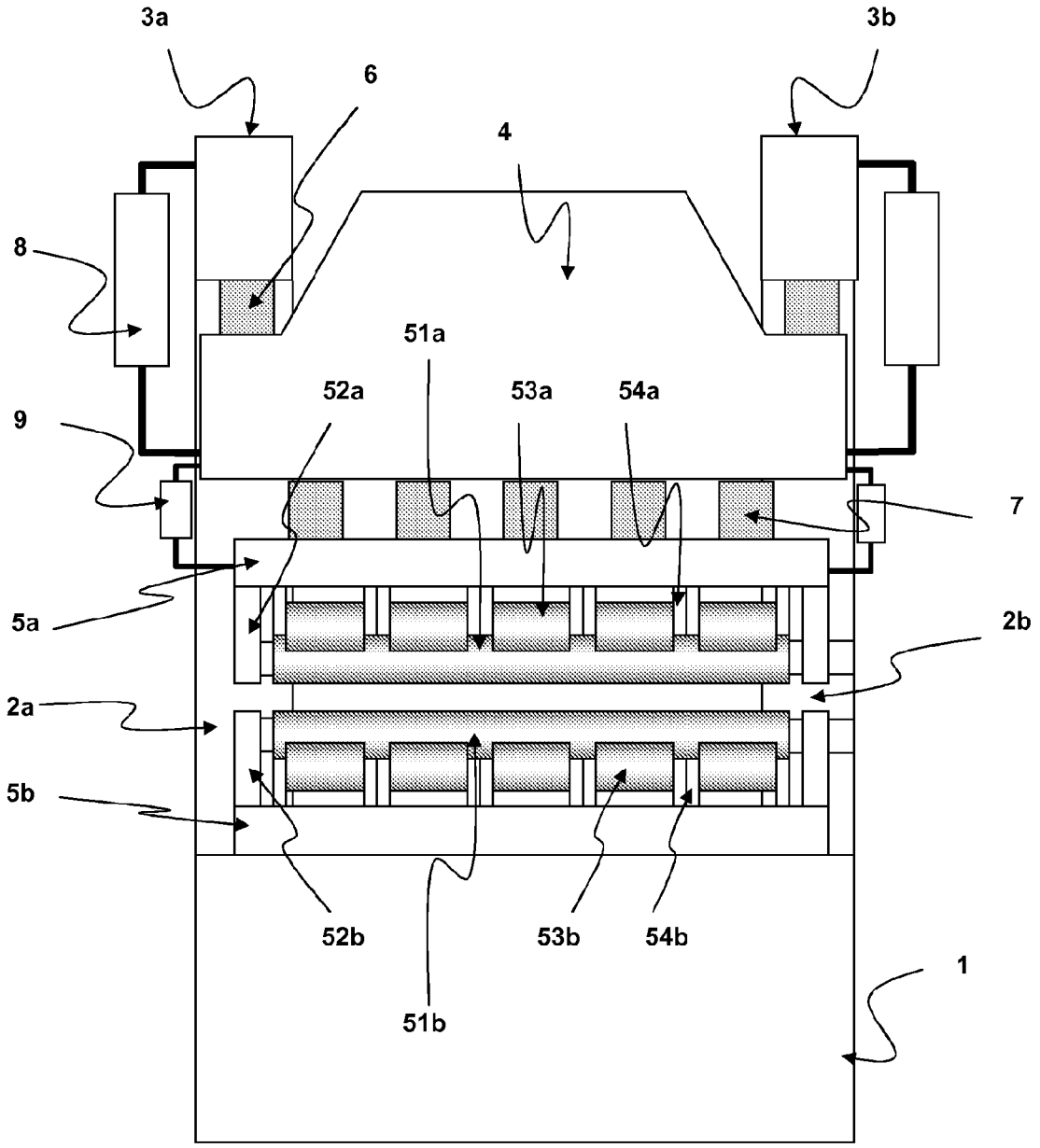
FIG. 1 PRIOR ART
FIG. 1, as already described, is a front schematic view of a leveling machine in the prior art.
Figure 2:
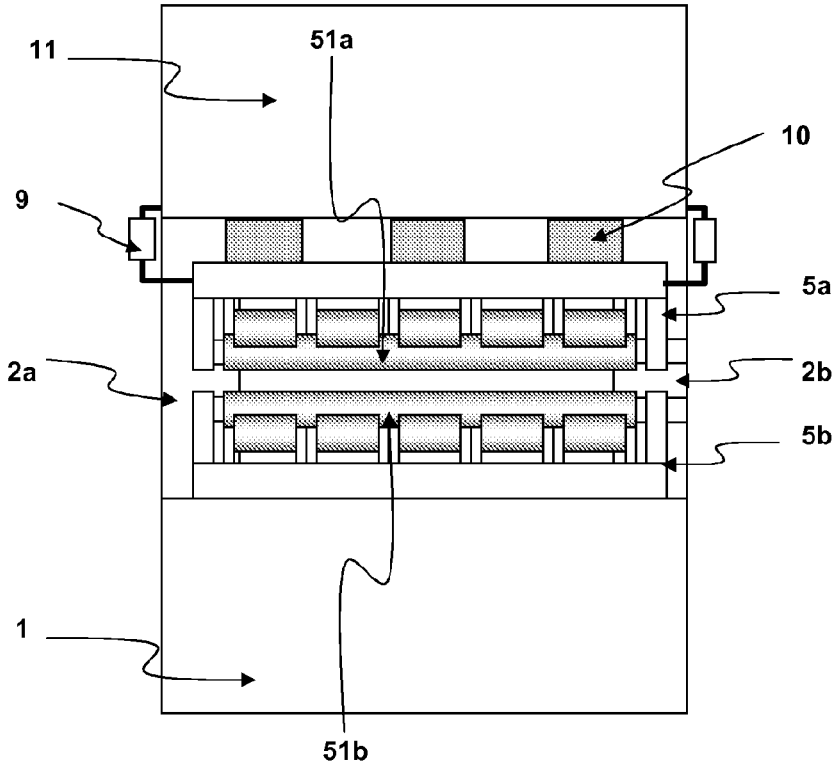
FIG. 2 is a front schematic view of a leveling machine according to the invention.

The leveling machine according to the invention shown in FIG. 2 includes a lower back plate 1, fixed during use of the leveling machine, supporting a lower leveling cassette 5*b*. Two pairs of vertical beams 2*a*, 2*b* extend upwards from the lower back plate 1 and are fixed rigidly to this latter. Furthermore, each pair of vertical beams 2*a*, 2*b* is placed on one side of an imaginary vertical plane passing through the longitudinal axis of movement P (shown in FIG. 4) of the strip of material. A fixed upper back plate 11 is attached rigidly to the upper extremity of each of the vertical beams 2*a*, 2*b*.

The leveling machine also comprises closing cylinders 10 attached firstly to the fixed upper back plate 11 and in contact secondly with an upper face of the upper leveling cassette 5*a*. When deployed, the closing cylinders 10 bear against the back plate 11 and force the rollers 51*a* of the upper leveling cassette 5*a* against the material to be leveled. The closing cylinders therefore cause firstly the rollers 51*a* of the upper leveling cassette and the rollers 51*b* of the lower leveling cassette 5*b* to move closer together and secondly, as a function of the relative vertical movement thereof, they offset the bending of the upper leveling cassette 5*a* caused by the separation stress generated by passage of the strip to be leveled.

Coupling means 9 attach the upper leveling cassette 5*a* to the back plate 11, while enabling vertical movement of the upper leveling cassette 5*a* under the action of the closing cylinders 7.

Figure 3:
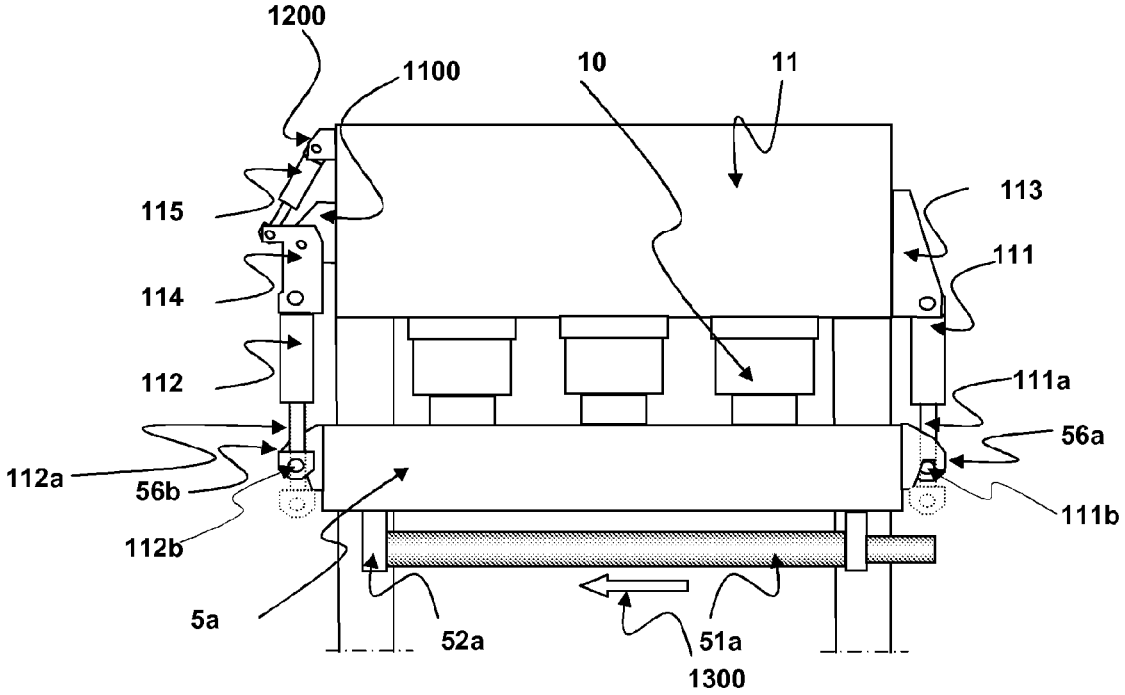
FIG. 3 is a detailed view showing a leveling cassette connected to the upper back plate of a leveling machine according to the invention.

FIG. 3 shows an embodiment of the coupling means. The upper leveling cassette 5*a* bearing the leveling rollers 51*a* and the bearings 52*a* thereof is coupled to the upper back plate 11 by means of two cylinders 111 supported on the roller drive side by flanges 113 of the upper back plate 11. Each head of the cylinder 111 is engaged in a retaining hook 56*a* of the upper leveling cassette 5*a*. For this purpose, each head of the cylinder 111 may include a cylindrical retaining portion 111*b*, the axis of which is perpendicular to the axis of the rod 111*a* of the cylinder 111. The upper leveling cassette 5*a* is also coupled to the upper back plate 11 by means of two more cylinders 112 supported on the side opposite the roller drive side by L-shaped parts 114 that are moveable in rotation in relation to the fixed upper back plate 11. Each head of the cylinder 112 is engaged in a retaining hook 56*b* of the upper leveling cassette 5*a*. For this purpose, each head of the cylinder 112 may include a cylindrical retaining portion 112*b* the axis of which is perpendicular to the axis of the rod 112*a* of the cylinder 112. Furthermore, each cylindrical retaining portion 111*b*, 112*b* may include two vertical stops located on either side of each retaining hook 56*a* that are intended to stop the upper leveling cassette 5*a* in horizontal translation. The cylinders 111, 112 therefore support the upper leveling cassette 5*a* while assisting the relative movements between the upper leveling cassette 5*a* and the upper back plate 11 under the action of the cylinders 10.

Each movable part 114 is fixed to an axle of the back plate 11 and can turn about this axle, each axle being supported by a flange 1100 of the back plate 11. At least one additional cylinder 115 able to pivot at least one movable part 114 extends between one extremity of the movable part 114 and one other flange 1200 of the back plate 11.

To remove the leveling equipment 5*a* and 5*b*, the rods of the closing cylinders 10 extend until the upper leveling cassette 5*a* is resting on the lower leveling cassette 5*b*. The rods 111*a* and 112*a* of the retaining cylinders 111, 112 follow the movement of the upper leveling cassette 5*a* downwards. Once the upper leveling cassette 5*a* is resting on the lower leveling cassette 5*b*, the rods 111*a* and 112*a* of the retaining cylinders 111, 112 continue their downward movement until each retaining hook 56*a* is released. By retracting, the additional cylinder 115 pivots the supporting element 114 which retracts the cylinder 112 upwards and the upper leveling cassette can be removed in the direction of the arrow 1300, from the side opposite the drive side of the leveling rollers 51*a*.

As mentioned previously, in leveling machines in the prior art, the pressure frame is guided between the vertical beams and the upper leveling cassette is coupled thereto using devices that follow the movements of the bend correction cylinders. In order to prevent double vertical guidance of the pressure frame and the cassette, which may cause butting and jamming, the upper cassette is not guided between the vertical beams or between the uprights of the lower cassette. In the machine according to the invention, the absence of the pressure frame enables the cassette to be guided itself between the vertical beams or between the uprights of the lower cassette, which considerably improves the precision of the movements thereof.

Figure 4:
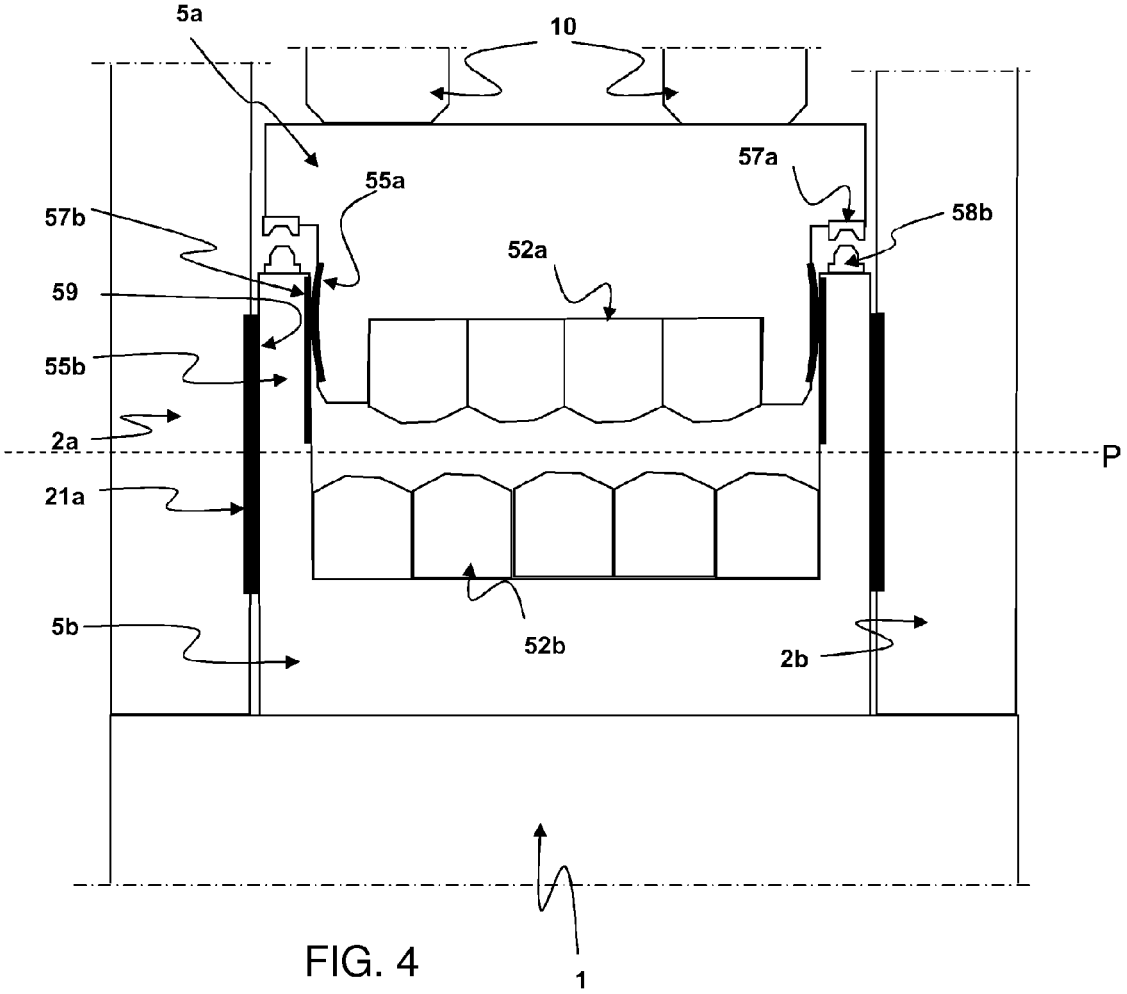
FIG. 4 is a cross-section view of FIG. 1.

FIG. 4 shows an embodiment of the system for guiding the leveling equipment between the beams 2*a* and 2*b*. It should be noted that FIG. 4 is a schematic cross-section view of the leveling machine taken through the bearings 52*a* and 52*b*, in a plane parallel to the imaginary vertical plane passing through the longitudinal axis of movement of the strip of material.

In general, each vertical beam 2*a*, 2*b* has an inner vertical contact surface 21*a* intended to cooperate with another contact surface to guide at least one leveling cassette 5*a*, 5*b* of the leveling machine in translation.

More specifically, the lower leveling cassette 5*b* includes vertical uprights 55*b* extending upwards from the base of the lower cassette 5*b* to guide it outside the leveling machine during assembly and disassembly operations. Each upright 55*b* includes an outer vertical surface 59 in contact with an inner vertical surface 21*a* of one of the beams 2*a*, 2*b* such as to ensure a precise positioning and to guide the lower leveling cassette 5*b* in translation. The uprights 55*b* and the lower leveling cassette 5*b* are therefore connected by a sliding joint. The two contact surfaces 59 and 21*a* extend at least partially facing one another.

Furthermore, each upright 55*b* of the lower leveling cassette 5*b* is positioned such as to act as a translational guide for the upper leveling cassette 5*a*. Consequently, each upright of the lower leveling cassette 5*b* also includes an inner vertical surface 57*b* in contact with an outer surface 55*a* of the upper leveling cassette. The contact surfaces 55*a* and 57*b*, extending at least partially facing one another when the leveling machine is fully assembled, cooperate to guide the upper leveling cassette 5*a* in translation in relation to the lower leveling cassette 5*b*. As the upper leveling cassette 5*a* is framed by the uprights 55*b*, the upper and lower leveling cassettes are therefore linked by a sliding joint which guarantees the relative positioning thereof to a high degree of accuracy. Furthermore, each outer contact surface 55*a* of the upper leveling cassette may be slightly convex. This enables an inclined position of the upper cassette 5*a* in relation to the lower cassette 5*b* between the strip input side between the leveling rollers and the output side.

Furthermore, the top of each of the uprights 55*b* of the lower leveling cassette 5*b* has a positioning contact 58*b* intended to receive a supporting element 57*a* of the upper leveling cassette 5*a*. During the cassette removal and replacement phases in the leveling machine, each positioning contact 58*b* receives a supporting element 57*a*, which guarantees the rigid attachment of the two cassettes.

In another embodiment not shown in the figures, the lower leveling cassette 5*b* does not have uprights 55*b* and the upper leveling cassette is guided in vertical translation directly by the beams 2*a*, 2*b* of the leveling machine. Thus, each outer contact surface 55*a* of the upper leveling cassette 5*a* cooperates with an inner vertical contact surface 21*a* of one of the beams 2*a*, 2*b*. The lower leveling cassette 5*a* is therefore connected to the uprights 2*a*, 2*b* of the leveling machine by a sliding joint.

In order to limit the wear generated by friction when guiding each of the elements in the leveling machine in translation, the contact surfaces 21*a*, 56*b*, 57*b* and 55*a* may be coated with an abradable material, encouraging parts such as surface-hardened steel plates to slide against one another.

To ensure that the closing cylinders 10 are able to correctly perform the function of correcting the leveling roller bend, there should preferably be at least six of them operating between the upper back plate 11 and the upper cassette 5*a*. As shown in FIGS. 2 to 5, the closing cylinders 10 are arranged in line in the same direction as the longitudinal axis of the rollers. In the embodiment according to the figures, the leveling machine has two lines of three closing cylinders 10 each. A first line of three closing cylinders 10 acts on the side the strip enters the upper leveling cassette 5*a*, while another line of closing cylinders acts on the output side of the leveling cassette, as shown schematically in FIG. 4.

An additional condition for the correct operation of roller bend correction is the deformation capacity of the upper leveling cassette in the same direction as the longitudinal axis of the rollers. This condition is easily satisfied when leveling thick strips, which involves very high levels of upper- and lower-cassette separation stress. In the case of thinner strips, it may be necessary to change the shape of the upper leveling cassette in order to reduce the bending inertia thereof.

Figure 5:
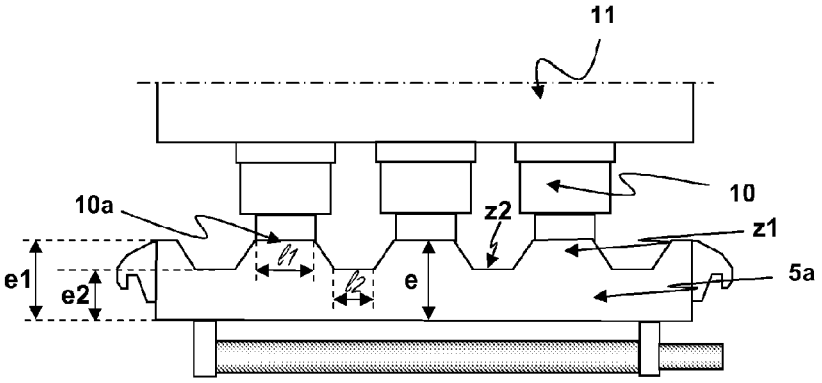
FIG. 5 is a cross-section view of a flexible upper leveling cassette used in a leveling machine according to the invention.

FIG. 5 shows an example of an upper leveling cassette having a greater bending deformation capacity than upper leveling cassettes in the prior art. The lower leveling cassette 5*a* shown in FIG. 5 has a lower deformation inertia than upper leveling cassettes in the prior art. In this cross-section view of a part of a leveling machine according to the invention, the thickness e of the upper leveling cassette 5*a* varies between a maximum value e1 and a minimum value e2. Each support surface of the closing cylinders 10 is located in a zone z1 where the thickness e of the upper leveling cassette 5*a* is greatest in order to ensure maximum resistance of the upper leveling cassette 5*a* against the bend-correction and closing stresses transmitted by the closing cylinders 10. Preferably, the length l1 of each zone of maximum thickness z1 is at least equal to the diameter of the extremity 10*a* of the cylinder 10 with which it is in contact. Furthermore, the zones z2 of minimum thickness e2 between the zones z1 of maximum thickness help to reduce the deformation inertia of the upper cassette 5*a* and thereby to achieve rapid and efficient bend correction. These zones z2 have a length l2 less than the length l1.

The embodiment shown in FIG. 5 includes five zones z1 of maximum thickness, two at the extremities of the upper leveling cassette 5*a* and three in the supporting portions of the upper leveling cassette 5*a* cooperating with the closing cylinders 10. These zones z1 of constant maximum thickness e1 are separated by three zones z2 of constant minimum thickness e2, facilitating the bending of the whole of the upper leveling cassette 5*a*. The upper leveling cassette therefore has a cross section in the shape of saw teeth truncated at the upper and lower parts thereof.

By way of example, the maximum thickness value may be between 1.5 and 4 times the minimum thickness value and may preferably be between 2 and 2.5 times this value.

The invention claimed is:

1. A leveling machine for leveling a strip of material, the leveling machine comprising:

a plurality of vertical beams each having an upper extremity;

a lower fixed back plate from which extends said plurality of vertical beams, said vertical beams disposed on either side of a longitudinal axis of movement of the strip of material;

leveling cassettes including:

a lower fixed leveling cassette, during operation of the leveling machine, said lower fixed leveling cassette bearing against said lower fixed back plate;

an upper leveling cassette, each of said lower and upper leveling cassettes having bearings and a plurality of rollers spaced out and mounted rotatingly in said bearings on axes perpendicular to the longitudinal axis of movement of the strip of material;

an upper fixed back plate rigidly connected to said vertical beams and rigidly attached to said upper extremity of each of said vertical beams;

a movable coupling device for coupling said upper leveling cassette to said upper fixed back plate enabling movement of said upper leveling cassette; and a moving device for moving said upper leveling cassette in a vertical translation in relation to said upper fixed back plate between a resting position in which said rollers of said upper leveling cassette are not close to said rollers of said lower fixed leveling cassette and a leveling position in which said rollers of said upper leveling cassette are close to said rollers of said lower fixed leveling cassette to cause the strip of material to follow an undulating route, said moving device being able to offset a bending of said upper leveling cassette caused by a separation stress attributable to a passage of the strip of material to be leveled.

2. The leveling machine according to claim 1, further comprising a movable part movable in relation to said upper fixed back plate;

wherein said upper fixed back plate has a flange;

wherein said upper leveling cassette has retaining hooks;

wherein said moveable coupling device includes:

a first set of cylinders placed on a first side of an imaginary vertical plane passing through the longitudinal axis of movement of the strip of material, each of said cylinders of said first set being fixed first to said flange of said upper fixed back plate and second to one of said retaining hooks of said upper leveling cassette; and a second set of cylinders placed on a second side of the imaginary vertical plane, each of said cylinders in said second set being fixed first to said movable part movable in relation to said upper fixed back plate and second to one of said retaining hooks of said upper leveling cassette.

3. The leveling machine according to claim 2, further comprising rotating drive means;

wherein said upper fixed back plate has a flange; and wherein said movable part is one of a plurality of movable parts, each one of said movable parts is fixed to said flange of said upper fixed back plate and at least one of said movable parts is driven in rotation by said rotating drive means.

4. The leveling machine according to claim 3, wherein:

said upper fixed back plate has a plate flange; and said rotating drive means includes at least one rotating drive cylinder, said drive cylinder being linked first to at least one of said movable parts and second to said plate flange of said upper fixed back plate.

5. The leveling machine according to claim 4, wherein when said rotating drive cylinder is actuated, at least one set containing one of said movable parts and one of said cylinders from said second set of cylinders is moved in rotation from a vertical position to a retracted position, the retracted position enabling said upper leveling cassette to be removed from the leveling machine.

6. The leveling machine according to claim 1, wherein said lower leveling cassette has a plurality of uprights extending upwards from a base of said lower fixed leveling cassette.

7. The leveling machine according to claim 1, wherein each of said vertical beams has an inner vertical contact surface intended to cooperate with another contact surface to guide at least one of said leveling cassettes of the leveling machine in translation.

8. The leveling machine according to claim 1, wherein said lower fixed leveling cassette has at least one outer vertical contact surface intended to cooperate with an inner vertical contact surface of one of said vertical beams such as to guide said lower fixed leveling cassette in translation during assembly and disassembly of the leveling machine.

9. The leveling machine according to claim 8, wherein said at least one outer vertical contact surface of said lower fixed leveling cassette belongs to an upright of said lower fixed leveling cassette extending upwards from a base of said lower fixed leveling cassette.

10. The leveling machine according to claim 1, wherein said lower fixed leveling cassette has an inner contact surface intended to guide said upper leveling cassette in translation.

11. The leveling machine according to claim 1, wherein said upper leveling cassette has at least one outer contact surface for guiding said upper leveling cassette in translation and is intended to cooperate with another contact surface of an element of the leveling machine.

12. The leveling machine according to claim 11, wherein said outer contact surface of said upper leveling cassette is convex.

13. The leveling machine according to claim 11, wherein:

each of said vertical beams has an inner vertical contact surface; and said upper leveling cassette has outer contact surfaces each cooperating with said inner vertical contact surface of one of said vertical beams.

14. The leveling machine according to claim 11, wherein said another contact surface of said element of the leveling machine is an inner vertical contact surface of said lower leveling cassette, each said outer contact surface of said upper leveling cassette cooperates with said inner vertical contact surface of said lower leveling cassette.

15. The leveling machine according to claim 1, wherein said moving device for moving said upper leveling cassette in vertical translation includes a plurality of closing cylinders rigidly connected to said upper fixed back plate and said upper leveling cassette.

* * * * *